United States Patent [19]

Wich

[11] Patent Number: 4,463,900

[45] Date of Patent: Aug. 7, 1984

[54] ELECTROMAGNETIC UNIT FUEL INJECTOR

[75] Inventor: Thomas J. Wich, Springfield, Mass.

[73] Assignee: General Motors Corporation, Detroit, Mich.

[21] Appl. No.: 457,417

[22] Filed: Jan. 12, 1983

[51] Int. Cl.[3] ..... F02M 49/00; F02M 55/00

[52] U.S. Cl. ..... 239/88

[58] Field of Search ..... 239/88–91, 239/95, 585; 251/139, 141

[56] References Cited

U.S. PATENT DOCUMENTS 4,392,612 7/1983 Deckard et al. ..... 239/88

4,408,718 10/1983 Wich ..... 239/88

*Primary Examiner*—John J. Love

*Assistant Examiner*—James R. Moon, Jr.

*Attorney, Agent, or Firm*—Arthur N. Krein

[57] ABSTRACT

An electromagnetic unit fuel injector for use in a diesel engine includes a housing having a bushing with an externally actuated plunger reciprocable therein to define a pump chamber open at one end for the discharge of fuel to a spring biased, pressure actuated fuel injection nozzle. The pump chamber is connected to a supply and spill chamber means via flow-through solenoid actuated, normally open, hollow pressure sensitive valve to permit the ingress and egress of fuel. The supply and spill chamber means adjacent to the head of the valve is in flow communication with a pressure equalization and spring chamber means at the opposite end of the valve via a passage through the valve and these chambers are in direct flow communication with a source of fuel at a relatively low supply pressure. During a pump stroke of the plunger, the solenoid can be energized, as desired, to push the pressure sensitive valve to a closed position relative to an associate valve seat so as to block flow from the pump chamber to the supply and spill chamber means thus allowing the plunger to effect pressurization of the fuel so as to effect discharge of fuel from the injection nozzle.

4 Claims, 5 Drawing Figures

ELECTROMAGNETIC UNIT FUEL INJECTOR

This invention relates to unit fuel injectors of the type used to inject fuel into the cylinders of a diesel engine and, in particular, to an electromagnetic unit fuel injector having a push-type, solenoid controlled, normally open, unbalanced valve therein.

DESCRIPTION OF THE PRIOR ART

Unit fuel injectors, of the so-called jerk type, are commonly used to pressure inject liquid fuel into an associate cylinder of a diesel engine. As is well known, such a unit injector includes a pump in the form of a plunger and bushing which is actuated, for example, by an engine driven cam whereby to pressurize fuel to a suitable high pressure so as to effect the unseating of a pressure actuated injection valve in the fuel injection nozzle incorporated into the unit injector.

In one form of such a unit injector, the plunger is provided with helices which cooperate with suitable ports in the bushing whereby to control the pressurization and therefore the injection of fuel during a pump stroke of the plunger.

In another form of such a unit injector, a solenoid valve is incorporated in the unit injector so as to control, for example, the drainage of fuel from the pump chamber of the unit injector. In this latter type injector, fuel injection is controlled by the energization of the solenoid valve, as desired, during a pump stroke of the plunger whereby to terminate drain flow so as to permit the plunger to then intensify the pressure of fuel to effect unseating of the injection valve of the associated fuel injection nozzle. An exemplary embodiment of such an electromagnetic unit fuel injector is disclosed, for example, in U.S. Pat. No. 4,129,253 entitled Electromagnetic Unit Fuel Injector issued Dec. 12, 1978 to Ernest Bader, Jr., John I. Deckard and Dan B. Kuiper.

In copending U.S. patent application Ser. No. 350,267, now U.S. Pat. No. 4,392,612, entitled Electromagnetic Unit Fuel Injector, filed Feb. 19, 1982, in the names of John I. Deckard and Robert D. Straub and, assigned to a common assignee, there is disclosed a unit injector wherein a normally open, pull-type solenoid actuated, pressure balanced valve is used to control the drain flow of fuel from the pump chamber during a pump stroke of the associate plunger. Fuel injection is initiated by energization of the solenoid to block drain flow of fuel from the pump chamber, thus allowing the continued plunger movement to intensify the pressure of fuel to a value to effect unseating of an associated pressure actuated injection valve. Upon deenergization of the solenoid, a valve spring effects unseating of the valve allowing the fuel pressure to drop and thereby to terminate injection.

SUMMARY OF THE INVENTION

The present invention provides an electromagnetic unit fuel injector that includes a pump assembly having a plunger reciprocable in a bushing and externally operated as, for example, by an engine driven rocker arm, with flow from the pump chamber during a pump stroke of the plunger being directed to a fuel injection nozzle assembly of the unit that contains a spring biased, pressure actuated injection valve therein for controlling flow out through the spray tip outlets of the injection nozzles. Fuel from the pump chamber can also flow through a passage means, containing a normally open, push-type solenoid actuated, hollow valve means to a chamber containing fuel as at a relatively low supply pressure. Fuel injection is regulated by the controlled energization of the solenoid actuated valve so that the valve is operatively positioned to block drain flow from the pump during a pump stroke of the plunger whereby the plunger is then permitted to intensify the pressure of fuel to a value to effect unseating of the injection valve. The valve means is positioned so as to be operable by a push-type solenoid, the valve, per se, being configured to allow pressurized fuel to effect quick opening movement of the valve when the solenoid is deenergized.

It is therefore a primary object of this invention to provide an improved electromagnetic unit fuel injector that contains a push-type, solenoid actuated pressure unbalanced valve means for controlling the start and end of injection.

Still another object of the present invention is to provide an electromagnetic unit fuel injector of the above type which includes features of construction, operation and arrangement, rendering it easy and inexpensive to manufacture and assemble, which is reliable in operation and in other respects suitable for use in production motor vehicle fuel systems.

For a better understanding of the invention, as well as other objects and further features thereof, reference is had to the following detailed description of the invention to be read in connection with the accompanying drawings.

DESCRIPTION OF THE PREFERRED EMBODIMENT

Figure 1:
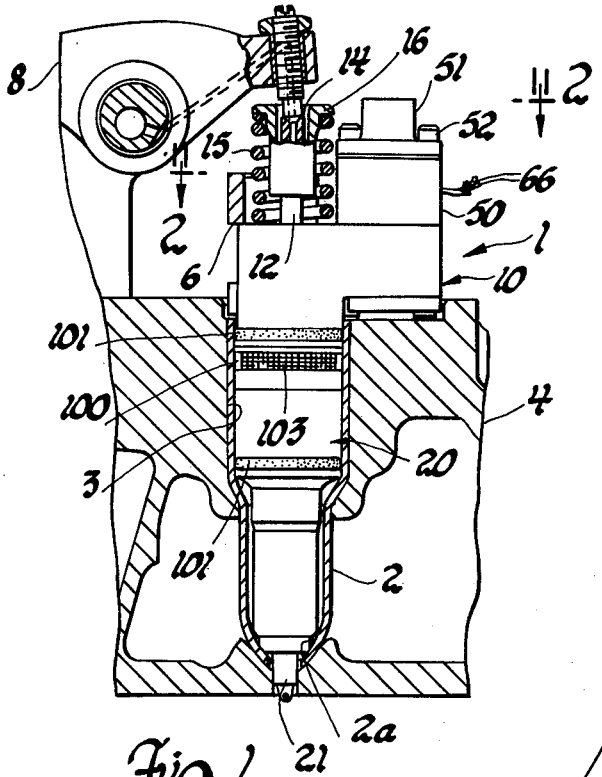
FIG. 1 is a sectional view of a portion of a diesel engine with an electromagnetic unit fuel injector of the invention mounted in the cylinder head thereof, the injector being shown in elevation.
Figure 2:
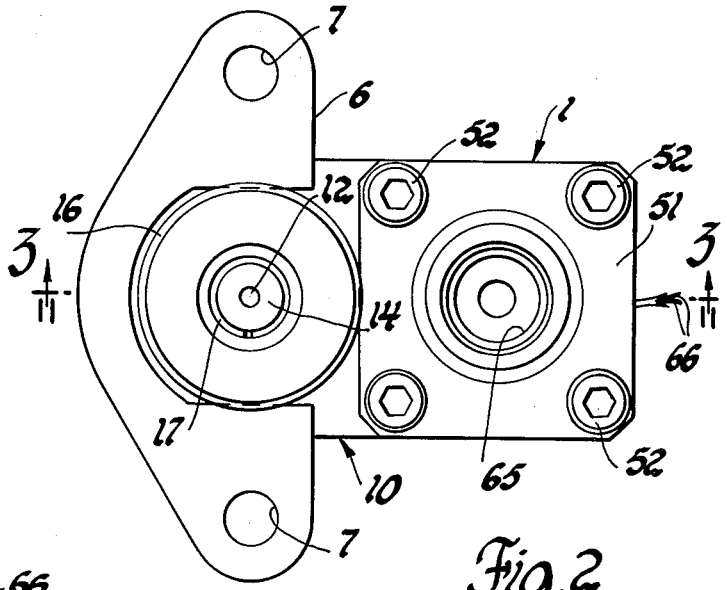
FIG. 2 is a top view of the injector and hold-down clamp assembly, per se, of FIG. 1.

Referring first to FIGS. 1 and 2, an electromagnetic unit injector, generally designated 1, is adapted to be mounted, for example, in an injector sheath 2 positioned in a suitable bore 3 provided for this purpose in the cylinder head 4 of a diesel engine so that the lower spray tip end of the injector projects from the cylinder head 4 for the discharge of fuel into the associate combustion chamber, not shown. As shown, the injector is axially fixed with a portion thereof in abutment against a seat **2*a* defined by a portion of the injector sheath 2 and it is suitably held in this position, as best seen in FIG. 2, by means of, for example, a C-shaped hold-down clamp 6 secured by suitable fasteners, not shown, which are adapted to be inserted through apertures 7 in the clamp for threaded engagement into the cylinder head 4** in a known manner.

Figure 3:
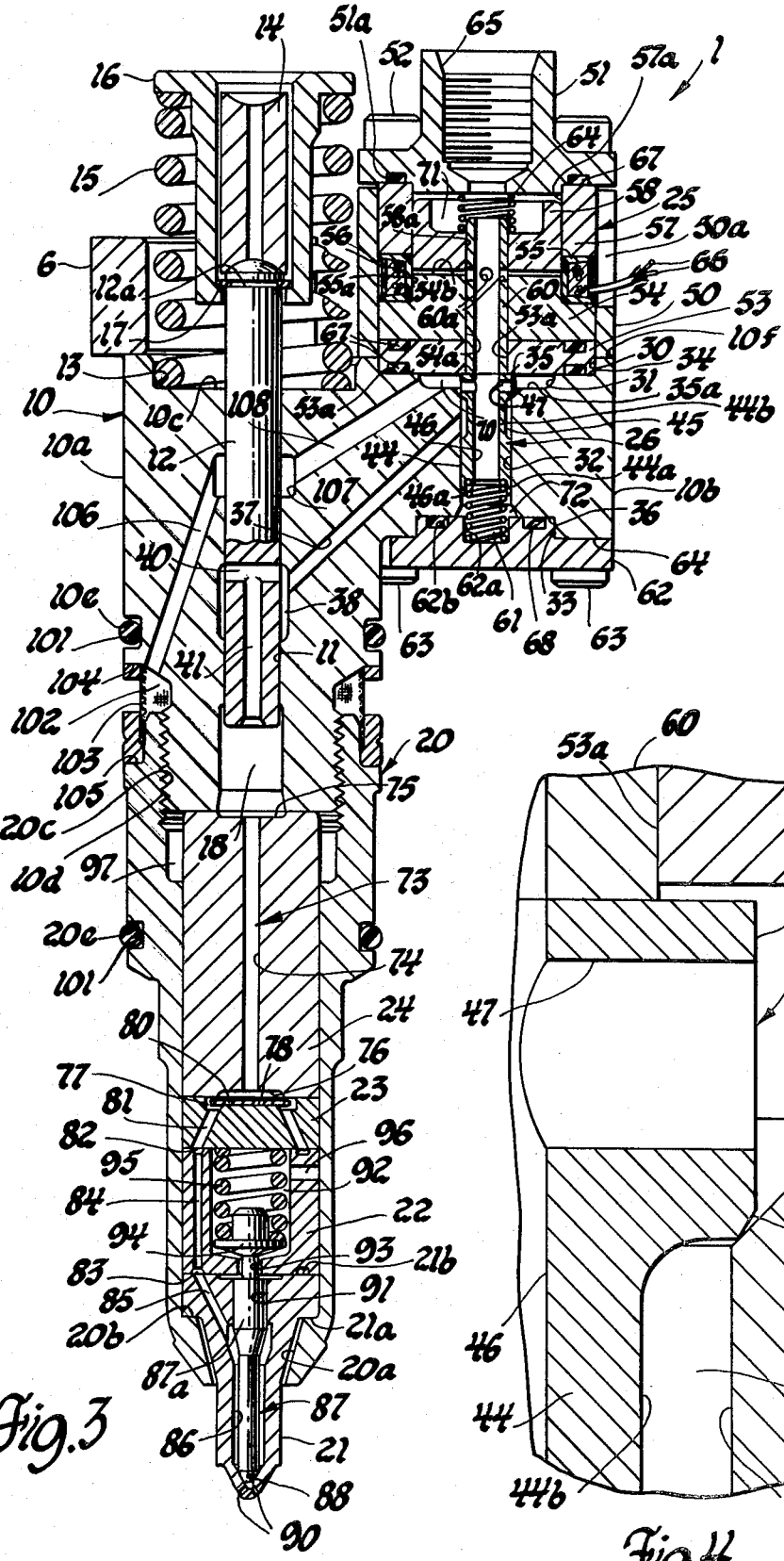
FIG. 3 is a longtitudinal sectional view of an electromagnetic unit fuel injector in accordance with a preferred embodiment of the invention, taken along line 3—3 of FIG. 2, with elements of the injector being shown so that the plunger of the pump thereof is positioned at near the beginning of a pump stroke and with the electromagnetic valve means thereof deenergized, and with parts of the unit shown in elevation.

Referring now to FIG. 3, there is shown an electromagnetic unit injector 1 constructed in accordance with a preferred embodiment of the invention. This injector 1 is, in effect, a unit fuel injector-pump assembly with a push-type, electromagnetic actuated, normally open valve incorporated therein to control fuel discharge from the injector portion of this assembly in a manner to be described.

In the construction illustrated, the electromagnetic unit fuel injector 1 includes an injector body 10 which is defined by a vertical main body portion 10*a* and an integral side body portion 10*b*. The body portion 10*a* is provided with a vertical extending stepped bore therethrough defining a lower cylindrical wall or bushing 11 of an internal diameter to slidably and sealingly receive a pump plunger 12 and an upper wall 13 of a larger internal diameter than that defining the bushing. A hollow actuator follower 14 abuts against the upper outboard portion of the plunger 12, whereby it and the plunger thus operatively connected thereto are adapted to be reciprocated, for example by an engine driven rocker arm 8, in a known manner as shown in FIG. 1. A plunger return spring 15 is operatively connected to the plunger 12 to normally bias it in a suction stroke direction. In the construction shown, a flanged tubular spring retainer 16 is operatively connected to the plunger 12 by means of a split ring 17 positioned in an annular groove 12*a* provided in the upper end of the plunger 12. As shown, the lower end of spring 16 is positioned to abut against a flat shoulder 10*c* interconnecting the wall 13 and bushing 11.

The pump plunger 12 forms with the bushing 11 a variable volume pump chamber 18 at the lower open end of the bushing 11.

In a conventional manner, a nut 20 is threaded to the lower end of the body 10 to form an extension thereof. Nut 20 has an opening 20*a* at its lower end through which extends the lower end of a combined injector valve body or spray tip 21, hereinafter referred to as the spray tip, of a conventional fuel injection nozzle assembly. As shown, the spray tip 21 is enlarged at its upper end to provide a shoulder 21*a* which seats on an internal shoulder 20*b* provided by the through counterbore in nut 20. Between the spray tip 21 and the lower end of the injector body 10 there is positioned, in sequence starting from the spray tip, a rate spring cage 22, a spring retainer 23 and a director cage 24, these elements being formed, in the construction illustrated, as separate elements for ease of manufacturing and assembly. Nut 20 is provided with internal threads 20*c* for mating engagement with the external threads 10*d* at the lower end of body 10. The threaded connection of the nut 20 to body 10 holds the spray tip 21, rate spring cage 22, spring retainer 23 and director cage 24 clamped and stacked end-to-end between the upper face 21*b* of the spray tip 21 and the bottom face of body portion 10*a*. All of these above-described elements have lapped mating surfaces whereby they are held in pressure sealed relation to each other.

Now in accordance with the invention, the ingress and egress of fuel to and from the pump chamber is controlled by a push-type solenoid, generally designated 25, actuated valve 26. The solenoid 25, in the embodiment shown in FIGS. 2 and 3, is a flow-thru type solenoid.

For this purpose, the side body portion 10*b* is also provided with a stepped bore therethrough to define circular internal walls including an upper wall 30, an upper intermediate wall 31, and intermediate valve stem guide wall 32 and a lower wall 33. Wall 33 and walls 31 and 30 are of progressively larger internal diameters than that of guide wall 32. Walls 30 and 31 are interconnected by a flat shoulder 34. Walls 31 and 32 are interconnected by a flat shoulder 35*a* which terminates with an inclined wall defining an annular conical valve seat 35 encircling wall 32. Walls 32 and 33 are interconnected by a flat shoulder 36.

The actual ingress and egress of fuel to the pump chamber 18 is by means of an inclined passage 37 provided in body 10. As shown in FIG. 3, the lower end of this passage 37 opens into an annular groove 38 provided in bushing 11 while the upper end thereof opens through the valve stem guide wall 32 in the side body portion 10*b* at a location to permit direct drilling of this passage. In the construction shown, this upper end of passage 37 breaks through wall 32.

Actual flow communication between this passage 37 and the pump chamber 18 via the groove 38 is by means of at least one radial passage 40 and an interconnecting axial passage 41 provided in the lower end of the plunger 12. As best seen in FIG. 3, the axial extent of the groove 38 is such that the radial passage 40 will be in flow communication therewith during the full operational reciprocation of the plunger 12.

Now in accordance with a feature of the invention, the flow of fuel through passage 37 is controlled by the solenoid 25 actuated normally open, pressure sensitive, poppet valve 26.

The poppet valve 26 includes a head 42 with a conical valve seat surface 43 thereon and a stem 44 depending therefrom. The stem 44 includes a lower portion 44*a* of diameter to be reciprocably received in the valve stem guide wall 32 and an upper portion 44*b* of reduced diameter next adjacent to the head 42 and of an axial extent so as to form with the valve stem guide wall 32 an annulus cavity 45 that is in communication with the passage 37 during opening and closing movement of the valve 26. In the construction shown in FIG. 3, the valve 26 is provided with a stepped axial bore 46 that extends through both the head 42 and stem 44 and, its head 42 is provided with radial ports 47 intersecting this bore for a purpose to be described hereinafter.

Figure 4:
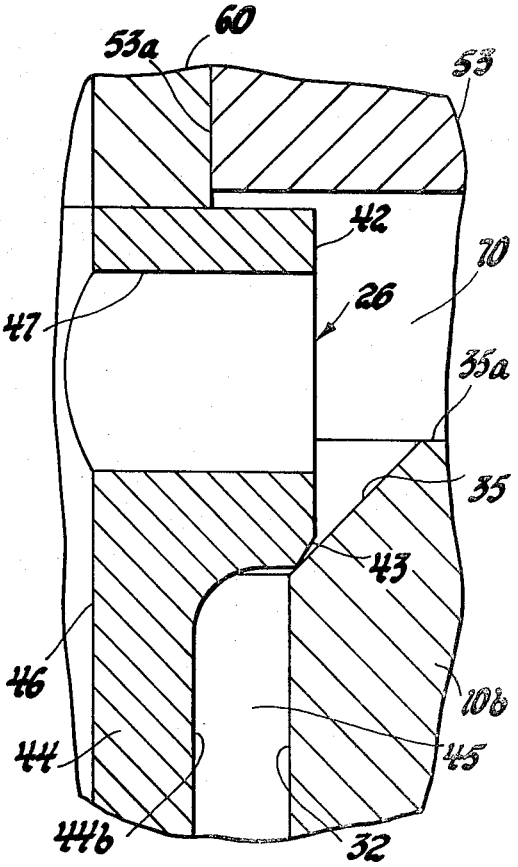
FIG. 4 is an enlarged view of a portion of the valve and valve seat, per se of the injector of FIG. 3 but with the valve shown closed and with the angle of the seating surface of the valve relative to the valve seat angle exaggerated for purposes of illustration; and, FIG. 5 is a longitudinal section view of a portion of an alternate embodiment fuel injector constructed in accordance with the invention and having a side inlet port.

Valve 26 is an unbalanced pressure valve in that the actual diameter of its valve seat surface 43 in line contact with the valve seat 35, when in its valve closed position as shown in FIG. 4, is a predetermined amount greater than the internal diameter of the valve stem guide wall 32 for a purpose to be described in detail hereinafter.

Referring now to the solenoid 25, used to control movement of the valve 26, this solenoid, in the embodiment shown in FIGS. 2 and 3, includes a circular sleeve housing 50 fixed in abutment against the upper machined surface 10*f* of the side body portion 10*b*, so as to be substantially concentric with the valve stem guide wall 32, by means of drain fitting cap 51 secured as by hex socket head screws 52 threaded into suitably threaded apertures provided for this purpose in the side body portion 10*b*.

Sandwiched between the shoulder 34 of the side body portion 10*b* and the bottom surface of the cap 51 are a spacer disc 53, a stepped pole piece 54, a bobbin 55 and solenoid coil 56 assembly and, a cylindrical spacer 57. Both the pole piece 54 and spacer 57 are made of a suitable material, for example, of silicon core iron. As shown, the pole piece 54 and spacer disc 53 are provided with central aligned apertures 54*a* and 53*a*, respectively.

A cup-shaped plunger armature 58 is slidably received by the internal bore wall 57*a* of spacer 57 and the internal wall 55*a* of bobbin 55 for reciprocable movement relative to the upper opposed surface 54*b* of pole piece 54.

The armature 58 is operatively connected to the valve 26 by means of a tube 60, made, for example, of stainless steel, which is slidably received through the apertures 53*a* and 54*a* of the spacer disc 53 and pole piece 54 respectively, and which is fixed adjacent to its upper end in the central aperture 58*a* of the armature 58. The tube 60 is provided with a plurality of radial ports 60*a* located so as to overlap the lower surface of the armature 58 and the upper surface of the pole piece so as to prevent fuel from being trapped between the opposed working surfaces of the armature 58 and pole piece 54.

The axial extent of the sleeve 60 depending below the armature 58 and the thickness of the spacer disc 53 are preselected so that with the bottom surface of sleeve 60 in abutment against the head 42 of valve 26 when the valve 26 is in its closed position, as shown in FIG. 4, a clearance will exist between the lower face of the armature 58 and the upper surface 54*b* of the pole piece 54 whereby a minimum fixed air gap will exist between these opposed working surfaces of the pole piece 54 and armature 58.

In a similar manner, the axial extent of the head 42 of valve 26 relative to the axial extent between its seating engagement with valve seat 35 and the lower surface of the spacer disc 53 are preselected so as to provide a predetermined opening travel movement of the valve 26 and to thus establish through the tube 60 a working air gap between the opposed working surfaces of the pole piece 54 and armature 58.

In a particular embodiment, the working air gap was 0.20 to 0.26 mm, while the minimum fixed air gap was 0.10 to 0.13 mm, with the valve 26 travel between its open and closed positions being 0.10 to 0.13 mm.

The valve 26 is normally biased in a valve opening direction, the position shown in FIG. 3, by means of a valve spring 61 having its upper end loosely received in the enlarged end of bore 46 at the lower end of the valve so that this end of the valve spring abuts against a shoulder 46*a*. The opposite end of the spring 61 is loosely received in a spring socket 62*a* in a cap 62 secured, as by cap screws 63 to the lower surface 64 of the side body portion 10*b*.

The armature 58 is in turn normally biased in an axial direction whereby the tube 60 fixed thereto is held in abutment against the head 42 of valve 26 by means of a solenoid spring 64 positioned at one end so as to loosely encircle the upper end of tube 60 and so as to abut against the upper recessed surface of the armature 58. The solenoid spring 64 at its other end is positioned to abut the lower surface of cap 51 in a position encircling the axial extending inlet passage 65 provided in this cap. Since valve 26 is a normally open valve, the valve spring 61 has a preselected force that is substantially greater than the force of the solenoid spring 64. In the particular application referred to hereinabove, the force of the valve spring 61 was approximately 6.26 N while that of the solenoid spring 64 was approximately 2.12 N.

The solenoid coil 56 is connectable by electrical conductors 66, that extend radially outward through a slot 50*a* in sleeve housing 50, to a suitable source of electrical power via a fuel injection electronic control circuit, not shown, whereby the solenoid coil can be energized as a function of the operating conditions of an engine in a manner well known in the art.

As shown in FIG. 3, suitable ring seals 67 positioned in suitable annular grooves 51*a* and 53*b* provided, for example, in the cap 51 and in opposite sides of the spacer disc 53, respectively, are used to effect a seal between the cap 51 and spacer 57 and between the spacer disc 53 on one side with the flat shoulder 34 and on its other side with the pole piece 54.

In a similar manner, a ring seal 68, positioned in an annular groove 62*b* provided for this purpose in the raised boss portion of cap 62 is used to effect a seal between the cap 62 and the flat shoulder 36 of the side body portion 10*b*.

With the above described structure, a supply/spill chamber 70 is defined by the lower surface of spacer disc 53 and the flat shoulder 35*a* and wall 31 of the body 10. In the embodiment shown in FIGS. 1 and 3, this supply/spill chamber 70 is supplied with filtered fuel at a predetermined supply pressure by a pump from a supply tank, both not shown, through a supply conduit provided in the cylinder head 4 and through a port, not shown, in the injector sheath 2 into a fuel supply chamber 100 to be described hereinafter, with fuel flow from the chamber 100 via passage means to be described in detail hereinafter. Fuel can then flow from the supply/spill chamber 70 into a chamber 71 defined by the internal wall of sleeve 57 and the opposed surfaces of the inlet fitting cap 51 and armature 58 via the tube 60 and the ports 47 in valve 26 from the supply/spill chamber 70.

In addition, both supply/spill chamber 70 and chamber 71 are in unrestricted fluid communication by means of the tube 60 and the bore 46 of valve 26 with a pressure equalizing/spring chamber 72 defined in part by the spring socket 62*a* and the lower valve stem guide wall 32 of the cap 62 and side body portion 10*b*, respectively.

During operation, on a pump stroke of plunger 12, pressurized fuel is adapted to be discharged from pump chamber 18 into the inlet end of a discharge passage means 73 to be described next hereinafter.

An upper part of this discharge passage means 73, with reference to FIG. 3, includes a vertical passage 74 extending from an upper recess 75 through director cage 24 for flow communication with an annular recess 76 provided in the lower surface of director cage 24.

As shown in FIG. 3, the spring retainer 23 is provided with an enlarged chamber 77 formed therein so as to face the recess 76 and, projecting upwardly from the bottom of the chamber 77 is a protuberance 78 which forms a stop for a circular flat disc check valve 80. The chamber 77 extends laterally beyond the extremities of the opening defining recess 76 whereby the lower end surface of the director cage 24 will form a seat for the check valve 80 when in a position to close the opening defined by recess 76.

At least one inclined passage 81 is also provided in the spring retainer 23 to connect the chamber 77 with an annular groove 82 in the upper end of spring cage 22. This groove 82 is connected with a similar annular groove 83 on the bottom face of the spring cage 22 by a longitudinal passage 84 through the spring cage. The lower groove 83 is, in turn, connected by at least one inclined passage 85 to a central passage 86 surrounding a needle valve 87 movably positioned within the spray tip 21. At the lower end of passage 86 is an outlet for fuel delivery with an encircling annular conical valve seat 88 for the needle valve 87 and, below the valve seat 88 are connecting spray orifices 90 in the lower end of the spray tip 21.

The upper end of spray tip 21 is provided with a bore 91 for guiding opening and closing movement of the needle valve 87. The piston portion 87*a* of the needle valve slidably fits this bore 91 and has its lower end exposed to fuel pressure in passage 86 and its upper end exposed to leakage fuel pressure in the spring chamber 92 via an opening 93, both being formed in spring cage 22. A reduced diameter upper end portion of the needle valve 87 extends through the central opening 93 in the spring cage and abuts a spring seat 94. Compressed between the spring seat 94 and spring retainer 23 is a coil spring 95 which normally biases the needle valve 87 to its closed position shown.

In order to prevent any tendency of fuel pressure to build up in the spring chamber 92, this chamber is vented through a radial port passage 96. While a close fit exists between the nut 20 and the spring cage 22, spring retainer 23 and director cage 24, there is sufficient diametral clearance between these parts for the venting of fuel back to a relatively low pressure area to be described in detail hereinafter.

In the construction illustrated, this fuel is drained into a cavity 97 defined by the internal wall of the nut 20 and the upper end of director cage 24, as best seen in FIG. 3.

In the construction shown and as best seen in FIG. 1, the lower end of the main body portion 10*a* and the upper end of the nut 20 of the injector 1, as positioned in an associate injector sheath 2, define with the interior wall thereof an annular fuel supply chamber 100 which is sealed at opposite ends by ring seals 101 located in suitable annular grooves 10*e* and 20*e* provided for this purpose in the body portion 10*a* and nut 20, respectively, as best seen in FIG. 3.

In addition, and as shown in FIG. 3, the main body portion 10*a* is provided with an annular groove 102 next adjacent to the upper end of nut 20 that is encircled by a fuel filter 103 axially retained between opposed shoulders 104 and 105 of the body portion 10*a* and nut 20, respectively.

In the injector construction illustrated, drainage fuel flow from the cavity 97 to the groove 102 is via the normal clearance path that exists between the mating threads 10*d* and 20*c* of the body portion 10*a* and nut 20.

Fuel flowing into the chamber defined by the groove 102 can then flow to the supply/spill chamber 70 via an inclined passage 106 provided in the main body portion 10*a* so as to extend from the chamber defined by groove 102 to an annular groove 107 in this body portion that is located so as to encircle plunger 12. Another inclined passage 108 extends from the groove 107 so as to open at its other end through wall 31 and shoulder 35 into the supply/spill chamber 70.

FUNCTIONAL DESCRIPTION

Referring now in particular to FIG. 3, during engine operation, fuel is supplied at a predetermined supply pressure by a pump, not shown, to the subject electromagnetic unit fuel injector 1 through a supply conduit, not shown, provided in the cylinder head 4 and through a port, not shown, in the injector sheath 2, into the supply chamber 100 and then through filter 103. Fuel thus admitted flows through the passage 106, groove 107 and passage 108 into the supply/spill chamber 70. Fuel at this supply pressure can also flow through the bore 46 of the hollow valve 26 into the pressure equalizing/spring chamber 72 and up through the ports 47 and tube into the chamber 71. Excess fuel can then flow from chamber 71 out through the drain passage 65 provided in cap 51.

With the solenoid coil 56 of solenoid 25 deenergized, and with the valve spring 61 being of a suitable force greater than that of solenoid spring 64, the valve spring 61 is operative to open and hold open the valve 26 relative to the valve seat 35. At the same time, the armature 58 which is operatively connected to the valve 26 by tube 60 is moved to a raised position relative to pole piece 54, the position shown in FIG. 3, whereby a predetermined working air gap is established between the opposed working surfaces of the armature 58 and pole piece 54, as previously described.

Thus during a suction stroke of the plunger 12, with the valve 26 then in its open position, fuel can now flow from the supply/spill chamber 70 through the annulus passage now defined between the valve seat surface 43 and valve seat 35 into the chamber defined by the reduced diameter upper valve stem portion 44*b* and then via passage 37 into the cavity defined by groove 38 and then through passages 40 and 41 into the pump chamber 18. At the same time, fuel will be present in the discharge passage means 73 used to supply fuel to the injection nozzle assembly.

Thereafter, as the follower 14 is driven downward as by the rocker arm 8 shown in FIG. 1, to effect a pump stroke of the plunger 12, that is downward movement of the plunger 12 with reference to FIG. 3, this downward pump stroke movement of the plunger will cause pressurization of the fuel within the pump chamber 18 and of course of the fuel in the passages 37 and 73 associated therewith. However, with the solenoid coil 56 still deenergized, this pressure can only rise to a level that is a predetermined amount less than the "pop" pressure required to lift the needle valve 87 against the force of its associate return spring 95.

During this period of time, the fuel displaced from the pump chamber 18 can flow via the passages 41, 40, the cavity defined by annular groove 38 and passage 37 back to the supply/spill chamber 70 since valve 26 is still open.

Thereafter, during the continued downward stroke of the plunger 12, an electrical (current) pulse of finite character and duration (time relative for example to the top dead center of the associate engine piston position with respect to the camshaft, not shown, and rocker arm linkage) applied through suitable electrical conductors to the conductors 66 of the solenoid coil 56 produces an electromagnetic field attracting the armature 58 downward, from the position shown in FIG. 3, toward the pole piece 54.

This movement of the armature 58 as coupled by the tube 60 to the valve 26 will effect seating of the valve 26 against its associate valve seat 35, the position of the valve shown in FIG. 4. As this occurs, the drainage of fuel from the pump chamber 18 via passage 37 in the manner described hereinabove will no longer occur. Without this spill of fuel from the pump chamber 18, the continued downward movement of the plunger 12 will increase the pressure of fuel therein to a "pop" pressure level to effect unseating of the needle valve 87. This then permits the injection of fuel out through the spray orifices 90. Normally, the injection pressure continues to build up during further continued downward movement of the plunger 12.

Ending the application of electrical current pulse to the solenoid coil 56 causes the electromagnetic field to collapse. As this occurs, the differential pressure acting on the valve 26 together with the force of the valve spring 61 causes immediate unseating of the valve 26 so as to allow spill fuel flow from the pump chamber 18 via the passages including passage 37 back to the supply/-spill chamber 70. This spill flow of fuel thus releases the injection nozzle system pressure as in the discharge passage means 73 so that the spring 95 can again effect seating of the valve 87. Of course, as the valve 26 is thus opened, the armature 58 via its tube 60 connection with the valve 26 will again be moved to its deenergized position, the position shown in FIG. 3.

Since the valve 26, in accordance with a feature of the invention, is a pressure sensitive valve, the high injection pressure fuel acting on the differential areas of the valve will result in rapid opening movement of this valve to terminate injection upon deenergization of the solenoid 25. This rapid opening movement of the valve can occur because the supply/spill chamber 71 and pressure equalizing/spring chamber 72 will always contain fuel at substantially equal pressures because of their flow interconnection by the bore 46 of the hollow valve 26.

For this purpose and as best seen with reference to FIGS. 4 and 3, the effective working area, of the valve stem 44 which is of annulus configuration, subjected to the fuel at a high injection pressure is less than the working area at the valve seat surface 43 end of the valve 27 and, since the fuel in the supply/spill chamber 70 and in the pressure equalizing chamber 72, as interconnected by the through bore 46 and ports 47 of the valve 26, are at a relatively low supply pressure, this differential pressure acting on the head 42 end of valve 26 will result in a rapid unseating of the valve which is assisted in its opening movement and then held open by the force of the valve spring 61.

As should now be apparent, in view of the high injection fuel pressures normally encountered in unit type injectors, as used in direct injection diesel engines, this differential in the working areas of the valve 26 need not be large and, in fact, should preferably be maintained as low as possible for a given application to reduce the force output required from the solenoid 25 in holding the valve 26 closed during energization of its coil 56. In addition the forces of the springs 61 and 64 and the differential in their forces can be kept relatively small.

As an example of the differential area sizes that have been found to be satisfactory in the above-identified injector 1 application, the valve stem guide wall 32 was formed with an internal diameter of 6.00 to 6.04 mm; the angle of the valve seat 35 was 90° to 91°; and, formed concentric with wall 32 within 0.003 mm TIR.

In this same application, the lower valve stem portion **44*a* of the valve had an outside diameter of 6.00 to 6.04, of selective fit, for sliding and sealing engagement in an associate valve stem guide wall 32; the upper stem portion 44*b* thereof had an external diameter of 4.5 to 4.7 mm; the outside diameter of its head 42 was 6.5 to 6.6 mm; the angle of its valve seat surface 43 was 88° 30′ to 89° 30′ concentric with stem 44 within 0.003 mm TIR; and, its effective contact annular line was 6.35 mm diameter gage at an axial distance of 2.57 to 2.62 mm from the upper surface of the head 42, with reference to FIGS. 3 and 4. In addition, 6 ports 47 were provided in the head 42. Since the minimum inside diameters of the opposed working areas of the valve 26 are the same, that is, the 4.5 to 4.7 mm diameter of the upper stem portion 44*b*, the relative differential areas of these opposed surfaces are, in effect, defined by the outside diameter of the lower stem portion 44*a* of stem 44 and the gage diameter of the valve seat surface 43 of valve head 42**.

The above-described opening movement of valve 26 results in the rapid flow of fuel from the annulus cavity defined by the reduced diameter upper stem portion **44*b* and wall 32 into the supply/spill chamber 70 resulting in an increase in the pressure of fuel therein which, of course, is immediately dissipated by flow communication of this chamber 70 via ports 47 and the bore 46 passage with the pressure equalizing/spring chamber 72. In addition these chambers 70 and 72 are also in direct flow communication with the inlet passage 65 and chamber 71, in the manner previously described, which passage and chamber also contain fuel at a relatively low supply pressure. Accordingly, the hydraulic force acting on the head portion of the valve 26 in a valve opening direction together with the force of valve spring 61 will be operative to effect rapid opening of the valve 26**.

DESCRIPTION OF ALTERNATE EMBODIMENT

Figure 5:
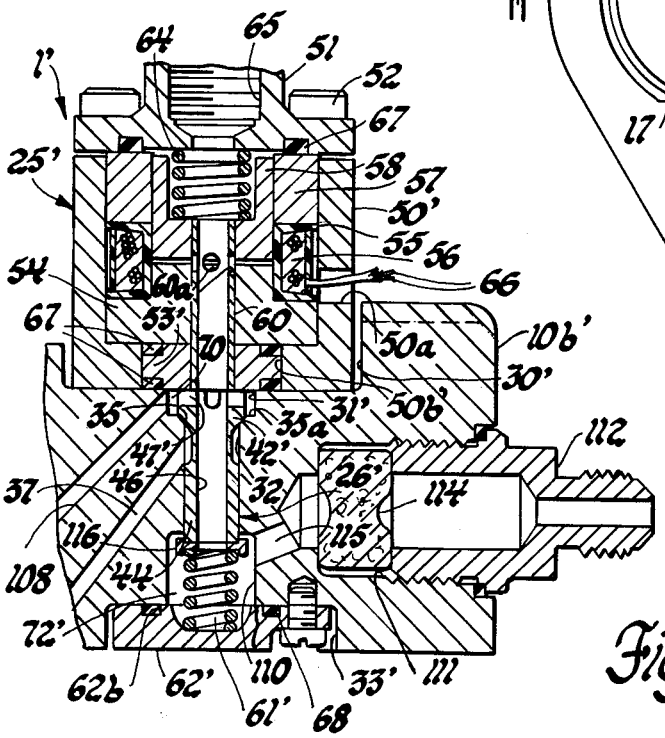

An alternate embodiment of an electromagnetic unit fuel injector, generally designated 1′, in accordance with the invention is shown in part in FIG. 5, wherein similar parts are designated by similar numerals, but with the addition of a prime (′) where appropriate. Only the side body portion of this alternate injector 1′ is shown in FIG. 5 since the main body portion **10*a* and the elements associated therewith are the same as in the injector 1 shown in FIG. 3**.

In this injector 1′, the side body portion **10*b*′ thereof is also provided with a vertical stepped bore defining an upper wall 30′, an upper intermediate wall 31′, a valve stem guide wall 32, a lower intermediate wall 110 and lower wall 33′. Wall 110 is of a larger internal diameter than wall 32 but smaller than wall 33′ so as to define, with the recessed portion of the cap 62′, a pressure equalizing/spring chamber 72′**.

In addition, the side body portion **10*b*′ is provided with an internally threaded inlet passage 111 extending inward from the free side thereof and which is adapted to threadingly receive a conventional apertured inlet or supply fitting 112 whereby this injector 1′ can be supplied, via a pump and conduit, both not shown, with fuel at a predetermined supply pressure. As shown, a conventional fuel filter 114 is suitably positioned in the inlet passage 111 and retained by the supply fitting 112. An inclined passage 115 interconnects the inlet passage 111 with the pressure equalizing/spring chamber 72′**.

As shown in FIG. 5, the valve 26′ is similar to previously described valve 26 of injector 1, except that the head 42′ thereof is provided with a plurality of U-shaped ports 47′ and that a dished disc spring retainer 116 is sandwiched between its lower stem 44 end thereof and the associate valve spring 61′.

The armature 58, in this alternate embodiment shown in FIG. 5, has its housing 50' of cup-shaped configuration with an opening slot 50*a* for the conductors 66 extending through the collar wall thereof and it is provided with a central opening 50*b'* through the base portion thereof of a size so as to receive the spacer disc 53' therein.

In this alternate injector 1' construction, the fitting cap 51 with its passage 65 therethrough also defines a drain passage for the return of fuel, as to a fuel tank, not shown, in a manner similar to that of the previously described embodiment. As is conventional in the diesel fuel injection art, it will be appreciated that a number of electromagnetic fuel injectors can be connected to a common drain conduit, not shown, which normally contains an orifice passage therein, not shown, used to control the rate of fuel flow through the drain conduit whereby to permit fuel pressure at a predetermined supply pressure to be maintained in each of the injectors.

As should now be apparent, the operation of the injector 1' embodiment of FIG. 5 is the same as that of the injector 1 embodiment of FIG. 3 as previously described hereinabove.

It should be noted that the pressure sensitive valve 26 or 26' in the respective injector embodiments can also operate as a pressure relief valve at high engine speeds.

While the invention has been described with reference to the particular embodiments disclosed herein, it is not confined to the details set forth since it is apparent that various modifications can be made by those skilled in the art without departing from the scope of the invention. This application is therefore intended to cover such modifications or changes as may come within the purposes of the invention as defined by the following claims.

The embodiments of the invention in which an exclusive property or privilege is claimed are defined as follows:

1. An electromagnetic unit fuel injector including a housing means having a pump cylinder means therein; an externally actuated plunger reciprocable in said cylinder means to define therewith a pump chamber; said housing means including a valve body having a spray outlet at one end thereof for the discharge of fuel; an injection valve means movable in said valve body to control flow through said spray outlet; a discharge passage means connecting said pump chamber to said spray outlet as controlled by said injection valve means; said housing means further including a supply/spill chamber means and a spring chamber means in axially spaced apart relationship to each other with a valve stem guide bore extending therebetween and with a conical valve seat encircling said guide bore at the supply/spill chamber end thereof; a passage means in said housing means in flow communication at one end with said pump chamber and at its other end with said guide bore next adjacent to said valve seat; a hollow, pressure sensitive valve operatively positioned in said housing means, said valve having a stem slidably received in said guide bore and a head loosely received in said supply/spill chamber with a valve seating surface for movement relative to said valve seat, the valve seating surface thereof being adapted to seat against said valve seat at a predetermined distance radially outward of said guide bore, said stem including a reduced diameter stem portion next adjacent to said valve seating surface of said head whereby to define with said guide bore an annulus chamber in fluid communication with said other end of said passage means; a push type solenoid means operatively supported in said housing means, said solenoid means including an armature means operatively associated with said valve; a first spring means operatively associated with said armature means to normally bias it into operative engagement with said valve; a second spring means, of a force greater than said first spring means, operatively associated with said valve to normally bias said valve seating surface of said head thereof out of seating engagement with said valve seat; and, a fuel passage means connectable at one end to a source of fuel at a suitable supply pressure and at its other end being in operative flow communication with said supply/spill chamber.

2. An electromagnetic unit fuel injector including a housing means having a pump cylinder means therein; an externally actuated plunger reciprocable in said cylinder means to define therewith a pump chamber; said housing means including a valve body having a spray outlet at one end thereof for the discharge of fuel; an injection valve means movable in said valve body to control flow through said spray outlet; a discharge passage means for the flow of fluid from said pump chamber to said spray outlet; said housing means further including a supply/spill chamber means and a pressure equalizing/spring chamber means in axially spaced apart relationship to each other with a valve stem guide bore extending therebetween and a conical valve seat encircling said guide bore at the supply/spill chamber end thereof; a passage means in said housing means in flow communication at one end with said pump chamber and at its other end with said guide bore next adjacent to said valve seat; a hollow, pressure sensitive valve operatively positioned in said housing means, said valve having a stem slidably received in said guide bore and a head loosely received in said supply/spill chamber with a valve seating surface for movement relative to said valve seat, the valve seating surface thereof being adapted to seat against said valve seat at a predetermined distance radially outward of said guide bore, said stem including a reduced diameter stem portion next adjacent to said valve seating surface of said head whereby to define with said guide bore an annulus chamber in fluid communication with said other end of said passage means, the effective area of said head subject to the pressure of fuel in said annulus chamber being a predetermined amount greater than the effective area of said stem subject to the pressure of fuel in said annulus chamber; a push type, flow through, solenoid means operatively supported in said housing means, said solenoid means including an armature means operatively associated with said valve; a first spring means operatively associated with said armature means to normally bias it into operative engagement with said valve; a second spring means, of a force greater than said first spring means, operatively associated with said valve to normally bias said valve seating surface of said head thereof out of seating engagement with said valve seat; and, a fuel passage means connectable at one end to a source of fuel at a suitable supply pressure and at its other end to said solenoid means for flow communication with said supply/spill chamber.

3. An electromagnetic unit fuel injector including a housing means having a pump cylinder means therein; an externally actuated plunger reciprocable in said cylinder means to define therewith a pump chamber; said housing means including a valve body having a spray outlet at one end thereof for the discharge of fuel; an injection valve means movable in said valve body to control flow through said spray outlet; a discharge passage means connecting said pump chamber to said spray outlet; said housing means further including a supply/spill chamber means and a pressure equalizing/-spring chamber means in axially spaced apart relationship to each other with a valve stem guide bore extending therebetween and a conical valve seat encircling said guide bore at the supply/spill chamber end thereof; a passage means in said housing means in flow communication at one end with said pump chamber and at its other end with said guide bore next adjacent to said valve seat; a hollow, pressure sensitive valve operatively positioned in said housing means, said valve having a stem slidably received in said guide bore and in flow communication with said pressure equalizing/-spring chamber and a head loosely received in said supply/spill chamber with a valve seating surface thereon for movement relative to said valve seat, the valve seating surface thereof being adapted to seat against said valve seat at a predetermined distance radially outward of said guide bore, said stem including a reduced diameter stem portion next adjacent to said valve seating surface of said head whereby to define with said guide bore an annulus chamber in fluid communication with said other end of said passage means; a push type solenoid means operatively supported in said housing means, said solenoid means including an armature means operatively associated with said valve; a first spring means operatively associated with said armature means to normally bias it into operative engagement with said valve; a second spring means, of a force greater than said first spring means, loosely positioned in said pressure equalizing spring chamber and operatively associated with said valve to normally bias said valve seating surface of said head thereof out of seating engagement with said valve seat; and, a fuel passage means connectable at one end to a source of fuel at a suitable supply pressure and at its other end being in operative flow communication with said supply/spill chamber.

4. An electromagnetic unit fuel injector including a housing means having a fuel passage means connectable at one end to a source of fuel for the ingress or egress of fuel at a suitable supply pressure, a supply/spill chamber means and a spring chamber means in axial spaced apart relationship to each other with a valve stem guide bore extending between said supply/spill chamber means and said spring chamber means with a conical valve seat encircling said guide bore at the supply/spill chamber end thereof; a pump cylinder means in said housing means; an externally actuated plunger reciprocable in said cylinder means to define therewith a pump chamber; said housing means including a valve body having a spray outlet at one end thereof for the discharge of fuel; a pressure actuated injection valve means movable in said valve body to control flow through said spray outlet; a discharge passage means connecting said pump chamber to said spray outlet; a passage means in said housing means in flow communication at one end with said pump chamber and at its other end with said guide bore next adjacent to said valve seat; a hollow, pressure sensitive valve including a stem slidably received in said guide bore, a head loosely received in said supply/spill chamber and having a conical valve seating surface for movement relative to said valve seat, said stem including a reduced diameter stem portion next adjacent to said valve seating surface of said head which defines with said guide bore an annulus chamber in fluid communication with said other end of said passage means; a push type solenoid means supported in said housing means and including an armature means operatively connected to said valve; a first spring means operatively associated with said armature means to normally bias it into operative engagement with said valve; and, a second spring means of a force greater than said first spring means positioned in said spring chamber means and operatively associated with said valve to normally bias said valve seating surface of said head out of seating engagement with said valve seat.

* * * * *